US007942012B2

(12) United States Patent
Ritchie et al.

(10) Patent No.: US 7,942,012 B2
(45) Date of Patent: May 17, 2011

(54) REFRIGERATOR WITH SELECT TEMPERATURE COMPARTMENT

(75) Inventors: Sheena L. Ritchie, Shepherdsville, KY (US); Mark Wilson, Simpsonville, KY (US); Alexander Rafalovich, Louisville, KY (US)

(73) Assignee: General Electric Company, Schenectady, NY (US)

( * ) Notice: Subject to any disclaimer, the term of this patent is extended or adjusted under 35 U.S.C. 154(b) by 551 days.

(21) Appl. No.: 12/175,407

(22) Filed: Jul. 17, 2008

(65) Prior Publication Data

US 2010/0011801 A1 Jan. 21, 2010

(51) Int. Cl.
*F25B 1/00* (2006.01)

(52) U.S. Cl. ..... 62/115; 62/441; 62/442

(58) Field of Classification Search ..... 62/115, 62/187, 441, 442, 426, 419, 515; 220/825, 220/833; 700/275, 278
See application file for complete search history.

(56) References Cited

U.S. PATENT DOCUMENTS

| | | | | |
|---|---|---|---|---|
| 3,788,089 | A | 1/1974 | Graves | |
| 3,803,862 | A | 4/1974 | Schumacher | |
| 5,187,941 | A * | 2/1993 | Tershak et al. | 62/89 |
| 5,758,512 | A * | 6/1998 | Peterson et al. | 62/407 |
| 5,924,301 | A | 7/1999 | Cook | |
| 6,058,731 | A | 5/2000 | Byczynski et al. | |
| 6,438,978 | B1 | 8/2002 | Bessler | |
| 6,675,603 | B1 | 1/2004 | Lesyna et al. | |
| 6,742,353 | B2 * | 6/2004 | Ohashi et al. | 62/443 |
| 6,782,706 | B2 | 8/2004 | Holmes et al. | |
| 6,802,369 | B2 | 10/2004 | Zentner et al. | |
| 6,880,949 | B2 | 4/2005 | Miozza et al. | |
| 6,952,930 | B1 | 10/2005 | Rafalovich et al. | |
| 7,051,549 | B2 * | 5/2006 | Kim et al. | 62/441 |
| 7,096,936 | B1 | 8/2006 | Chastine et al. | |
| 7,237,395 | B2 | 7/2007 | Rafalovich et al. | |
| 7,665,326 | B2 * | 2/2010 | LeClear et al. | 62/441 |
| 7,681,406 | B2 * | 3/2010 | Cushman et al. | 62/72 |
| 7,866,167 | B2 * | 1/2011 | Kopf | 62/66 |
| 2002/0104325 | A1 * | 8/2002 | Mandel et al. | 62/187 |
| 2003/0097850 | A1 | 5/2003 | Chang et al. | |
| 2003/0115892 | A1 * | 6/2003 | Fu et al. | 62/187 |
| 2003/0167787 | A1 * | 9/2003 | Ohashi et al. | 62/443 |
| 2006/0191285 | A1 * | 8/2006 | Rand et al. | 62/408 |
| 2008/0000256 | A1 * | 1/2008 | Shin | 62/407 |
| 2008/0155997 | A1 * | 7/2008 | LeClear et al. | 62/66 |

* cited by examiner

*Primary Examiner* — Mohammad Ali
(74) *Attorney, Agent, or Firm* — Fay Sharpe LLP

(57) ABSTRACT

A dual evaporator refrigerator includes a freezer compartment and a refrigeration compartment with an enclosed pan. A freezer evaporator with a freezer fan is in the freezer compartment for cooling the freezer compartment and a refrigeration evaporator with a first refrigeration fan is in the refrigeration compartment for cooling the refrigeration compartment. A compressor provides refrigerant flow to the freezer and the refrigeration evaporators. A second refrigeration fan moves air from the refrigeration evaporator to the enclosed pan.

21 Claims, 5 Drawing Sheets

200

202

204

| MODE | COMPRESSOR | 3-WAY VALVE | FR FAN | RF FAN | PAN FAN | HEATER | DAMPER |
|---|---|---|---|---|---|---|---|
| COOL FR COMPARTMENT | ON | F | ON | OFF | OFF | OFF | OPEN/MAIN |
| COOL FR AND RF COMPARTMENTS | ON | F/R | ON | ON | OFF | OFF | OPEN/MAIN |
| COOL FR AND RF COMPARTMENTS, AND COOL PAN | ON | F/R | ON | ON | ON | OFF | OPEN/MAIN |
| COOL FR COMPARTMENT, AND COOL PAN | ON | F/R | ON | OFF | ON | OFF | OPEN/MAIN |
| COOL RF COMPARTMENT | ON | R | OFF | ON | OFF | OFF | OPEN/MAIN |
| COOL RF COMPARTMENT, AND COOL PAN | ON | R | OFF | ON | ON | OFF | OPEN/MAIN |
| COOL PAN | ON | R | OFF | OFF | ON | OFF | OPEN/MAIN |
| COOL FR AND RF COMPARTMENTS, AND HEAT PAN | ON | F/R | ON | ON | ON | ON | CLOSED/BYPASS |
| COOL FR COMPARTMENT, AND HEAT PAN | ON | F | ON | OFF | ON | ON | CLOSED/BYPASS |
| COOL RF COMPARTMENT, AND COOL PAN | ON | R | OFF | ON | ON | ON | CLOSED/BYPASS |
| HEAT PAN | OFF | - | OFF | OFF | ON | ON | CLOSED/BYPASS |

*Fig. 5*

REFRIGERATOR WITH SELECT TEMPERATURE COMPARTMENT

BACKGROUND

The present disclosure generally relates to refrigerators, and more particularly relates to a dual evaporator refrigerator having a select temperature pan or compartment.

Evaporator-type refrigerators often include a fresh food compartment and a freezer compartment. These refrigerators usually employ a closed-loop cooling circuit for cooling the fresh food and freezer compartments. More particularly, the closed-loop cooling circuit can include a compressor, one or more evaporators for exchanging heat with the fresh food and freezer compartments, and a condenser. A fan can be provide in association with each evaporator used in the closed-loop circuit for blowing exchange air over the evaporator to more effectively cool the compartments.

In one configuration, a single evaporator is used to cool both the fresh food and freezer compartments. In this type of configuration, the single evaporator is typically disposed within the freezer compartment and airflow communication is needed between the freezer compartment and the fresh food compartment. Drawbacks associated with this arrangement include undesirably low humidity in the fresh food compartment due to moisture moving to the evaporator disposed within the freezer compartment (i.e., the coldest surface) and condensing thereon, and odors from the fresh food compartment passing into the freezer compartment. Such odors can become entrapped in the ice cubes made in the freezer compartment.

In another configuration, a pair of evaporators is used to cool the fresh food and freezer compartments. More particularly, a fresh food evaporator can be disposed within the fresh food compartment for cooling thereof and a freezer evaporator can be disposed within the freezer compartment for cooling thereof. When two evaporators are employed in a cooling circuit, a multi-way valve can be used to selectively direct the refrigerant between the evaporators. For example, depending on a position of the valve and refrigerator compartment conditions, part of the refrigerant may flood in one evaporator and be unavailable for use in another. This alternate configuration eliminates the humidity and odor problems, but is still somewhat limited.

For example, the fresh food compartment evaporator is typically limited to a temperature between about 34° F. to about 45° F. (about 1.1° C. to about 7.2° C.). The fresh food evaporator can thus be set to cool the entire fresh food cooling compartment to a temperature within this range (e.g., 37° F. or 2.8° C.). In some cases, however, it may be desirable to store an item (or a few items) at a cooled temperature other than that of the fresh food compartment. This other temperature may be a temperature within the fresh food evaporator range, but different than the temperature preferred for other items in the fresh food compartment (e.g., the fresh food compartment may be set at a preferred temperature of 37° F. or 2.8° C., but some item are preferably defrosted at a temperature of 40° F. or 4.4° C.). Alternatively, this other temperature may be outside the fresh food evaporator range, but not at room temperature or the temperature of the freezer compartment (e.g., an item, such as fresh fish, is preferably stored at a temperature of 30° F. or −1.1° C.).

SUMMARY

According to one aspect, a dual evaporator refrigerator is provided. More particularly, in accordance with this aspect, the dual evaporator refrigerator includes a freezer compartment and a refrigeration compartment with an enclosed pan. The dual evaporator refrigerator also includes a freezer evaporator with a freezer fan for moving air from the freezer evaporator to the freezer compartment for cooling the freezer compartment and a refrigeration evaporator with a first refrigeration fan for moving air from the refrigeration evaporator to the refrigeration compartment for cooling the refrigeration compartment. A compressor provides refrigerant flow to the freezer and the refrigeration evaporators. A second refrigeration fan moves air from the refrigeration evaporator to the enclosed pan.

According to another aspect, a dual evaporator refrigerator is provided. More particularly, in accordance with this aspect, the dual evaporator refrigerator includes a fresh food evaporator and a fresh food fan for cooling a fresh food compartment. The dual evaporator refrigerator also includes a freezer evaporator and a freezer fan for cooling a freezer compartment. A compressor and a condenser are on a fluid circuit with the fresh food evaporator and the freezer evaporator for circulating a refrigerant through the fresh food and the freezer compartments. An auxiliary fan forces air from the fresh food evaporator into an enclosed compartment disposed within the fresh food compartment for independently controlling cooling within the enclosed compartment.

According to yet another aspect, a control method for a dual evaporator refrigerator is provided. More particularly, in accordance with this aspect, refrigerant is selectively provided to a fresh food evaporator disposed in a fresh food compartment. Refrigerant is also selectively provided to a freezer evaporator disposed in a freezer compartment. A fresh food fan adjacent the fresh food evaporator is selectively operated when the refrigerant is provided to the fresh food evaporator for cooling the fresh food compartment. A freezer fan adjacent the freezer evaporator is selectively operated when the refrigerant is provided to the freezer evaporator for cooling the freezer compartment. An auxiliary fan is selectively operated that directs air flow from the fresh food evaporator to an enclosed compartment disposed within the fresh food compartment.

BRIEF DESCRIPTION OF THE DRAWINGS

FIG. 5 is a control matrix for operating the refrigerator of FIG. 1.

DETAILED DESCRIPTION

Figure 1:
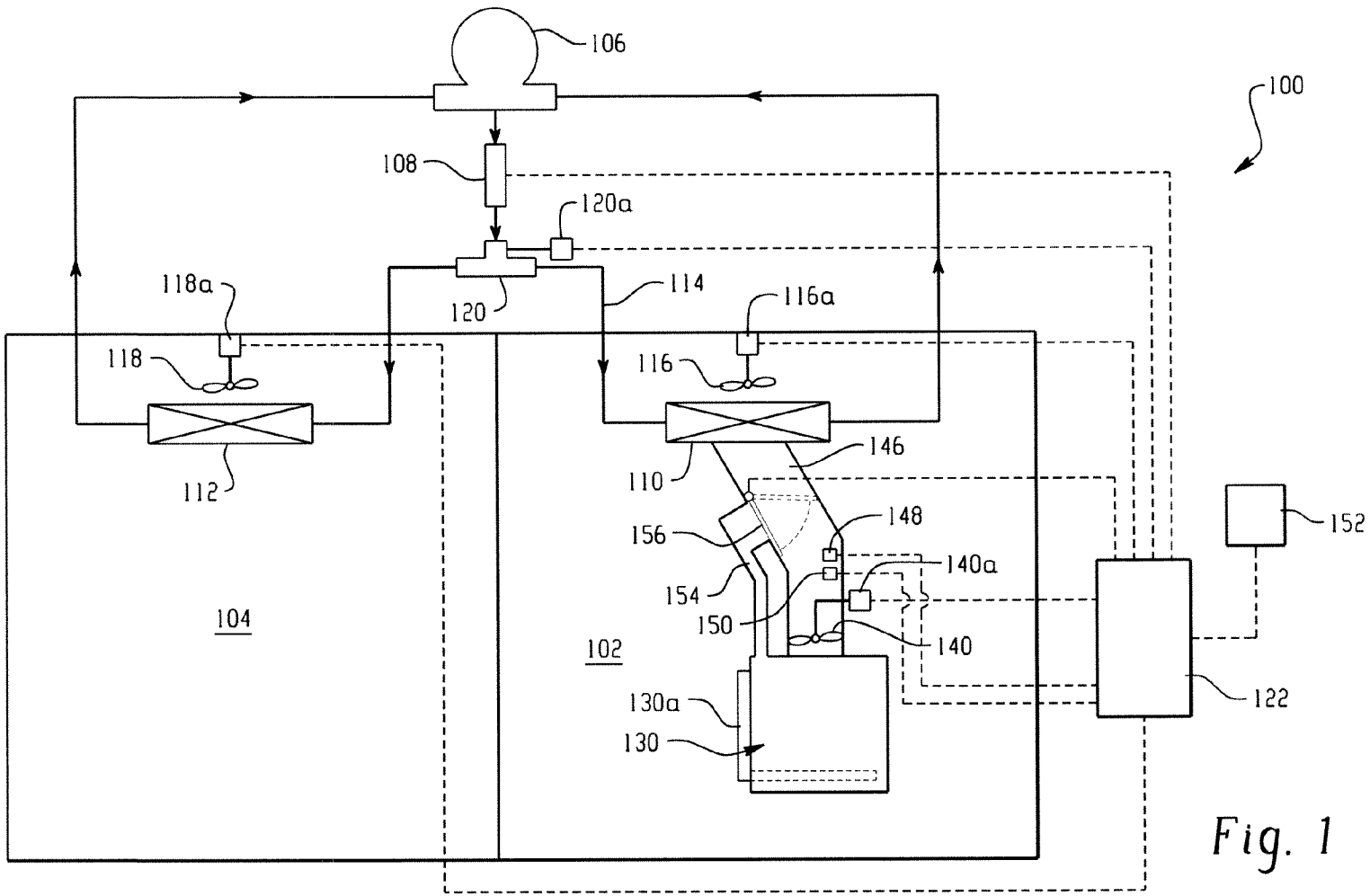
FIG. 1 is a schematic illustration of a refrigerator having a fresh food compartment cooled by a fresh food evaporator and a freezer compartment cooled by a freezer evaporator.

Referring now to the drawings wherein showings are for purposes of illustrating one or more exemplary embodiments, FIG. 1 schematically illustrates a dual evaporator refrigerator 100 including a fresh food storage compartment 102, also referred to herein as a refrigeration compartment, and a freezer storage compartment 104, also referred to herein as a freezer compartment. By way of example only, the refrigerator 100 can be a side-by-side refrigerator wherein the fresh food compartment 102 and the freezer compartment 104 are arranged in side-by-side relation. It is contemplated, however, that the teaching of the description set forth below is applicable to other types of refrigeration arrangements and appliances, including but not limited to top and bottom mount refrigerators, etc.

In accordance with known refrigerators, the refrigerator 100 can include a machinery compartment (not shown) that at least partially contains components for executing a known vapor compression cycle for cooling air. The components can include a compressor 106, a condenser 108, at least two evaporators 110,112 and one or more expansion devices (not shown), all interconnected in a refrigeration circuit 114 and charged with a refrigerant. As is known and understood by those skilled in the art, the evaporators 110,112 are types of heat exchangers which transfer heat from air passing thereover to the refrigerant flowing therethrough, thereby causing the refrigerant to vaporize. The cooled air is then used to refrigerate one or more refrigerator or freezer compartments via fans, such as fans 116,118. Collectively, the vapor compression cycle components in a refrigeration circuit, associated fans, and associated components can be referred to as a sealed system or a closed-loop vapor compression cooling circuit.

More particularly, the evaporator 110 can be a refrigeration evaporator with a fresh food fan 116 in the refrigeration compartment 102 for cooling thereof. The evaporator 112 can be a freezer evaporator with a freezer fan 118 in the freezer compartment 104 for cooling of the freezer compartment. As will be described below in more detail, the compressor 106 selectively provides refrigerant flow to the freezer and refrigeration evaporators 110,112 for cooling of the respective compartments 102,104. In an exemplary embodiment, the compressor 106 is a variable speed compressor, and the fans 116,118 can each be variable speed fans coupled to their respective evaporators 110,112 for circulating air through their respective evaporators.

As shown, the compressor 106 can be connected in series with the condenser 108 and a flow control device 120 which regulates flow of refrigerant to each of the fresh food evaporator 110 and the freezer evaporator 112. Particularly, the flow control device 120 directs the refrigerant to the fresh food evaporator 110 when cooling of the fresh food compartment 102 is desired and directs the refrigerant to the freezer evaporator 112 when cooling of the freezer compartment 104 is desired. In an exemplary embodiment, the flow control device 120 is a three-way valve with a stepper motor 120*a* that controls flow of the refrigerant to the freezer and refrigeration evaporators 110,112.

As is known and understood by those skilled in the art, step per motor 120*a* of three-way valve 120 can operate by a series of impulses that moves the valve 120 incrementally in a plurality of steps between a plurality of operational positions. For example, the valve 120 can be moved to a closed position wherein no refrigerant is allowed to pass to either of the evaporators 110,112, to a second position where all refrigerant is directed to the evaporator 110, a third position wherein all refrigerant is directed to the evaporator 112, or any intermediate position (e.g., supplying a proportioned amount of refrigerant to the fresh food evaporator 110 and the freezer evaporator 112).

As shown schematically in FIG. 1, a controller or control unit 122 can be operatively connected (e.g., via wires or wirelessly) to the refrigeration fan 116, the freezer fan 118, the compressor 106 and the three-way valve 120 for controlling operation thereof. More specifically, as is known and understood by those skilled in the art, the fans 116,118 can each include respective motors 116*a*,118*a* to which the controller 122 is operatively connected for operation thereof.

Figure 2:
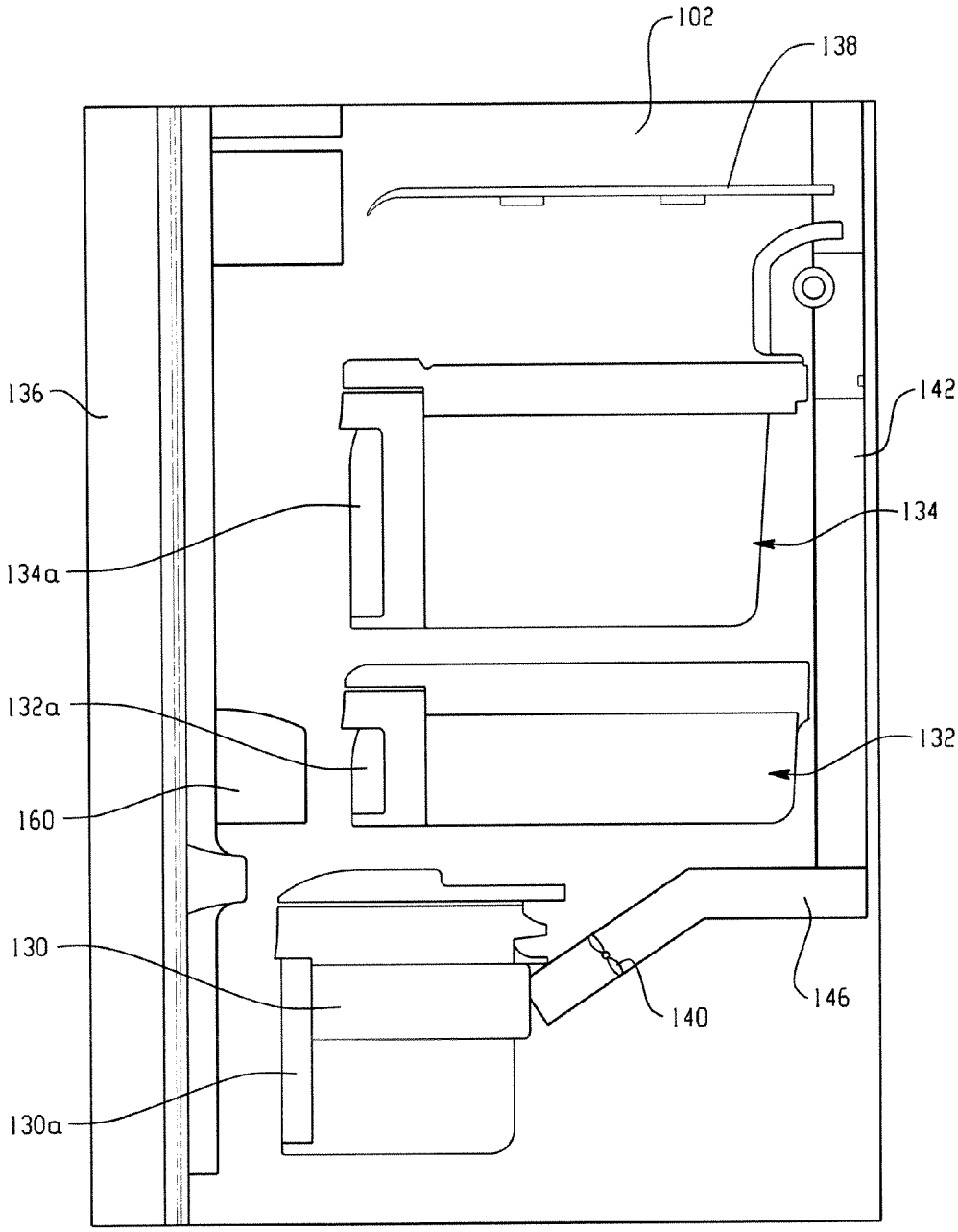
FIG. 2 is a side elevational view into the fresh food compartment showing an enclosed auxiliary compartment or pan thermally connected to the fresh food evaporator by an air duct.

With additional reference to FIG. 2, an enclosed pan or compartment 130 is disposed within the fresh food compartment 102. In the illustrated embodiment, the enclosed compartment 130 is constructed similar to conventional slide-out drawer compartments, such as drawer compartments 132, 134, that are normally provided in a refrigerator's fresh food compartment to support items being stored therein. That is, a door 136 to the fresh food compartment 102 is opened to gain access to the compartment 102 and then a drawer (such as drawer 130*a*, drawer 132*a*, or drawer 134*a*) is pulled open to gain access to a respective one of the compartments 130,132, 134. Of course, other structures can be provided within the fresh food compartment 102 for supporting and storing items therein, such as shelves (e.g., shelf 138) and door compartments or receptacles (e.g., door receptacle 160). Unlike the conventional drawer compartments 132,134, the select temperature pan or compartment 130 includes an auxiliary fan 140 for forcing air from the fresh food evaporator 110 into the enclosed compartment 130 for independently controlling cooling and/or heating within the enclosed compartment 130. If desired, the enclosed compartment 130 can be insulated to more efficiently maintain any difference in temperature between the pan 130 and the fresh food compartment 102, though this is not required and the walls/drawer forming the compartment 130 will provide some inherent insulation.

Figure 3:
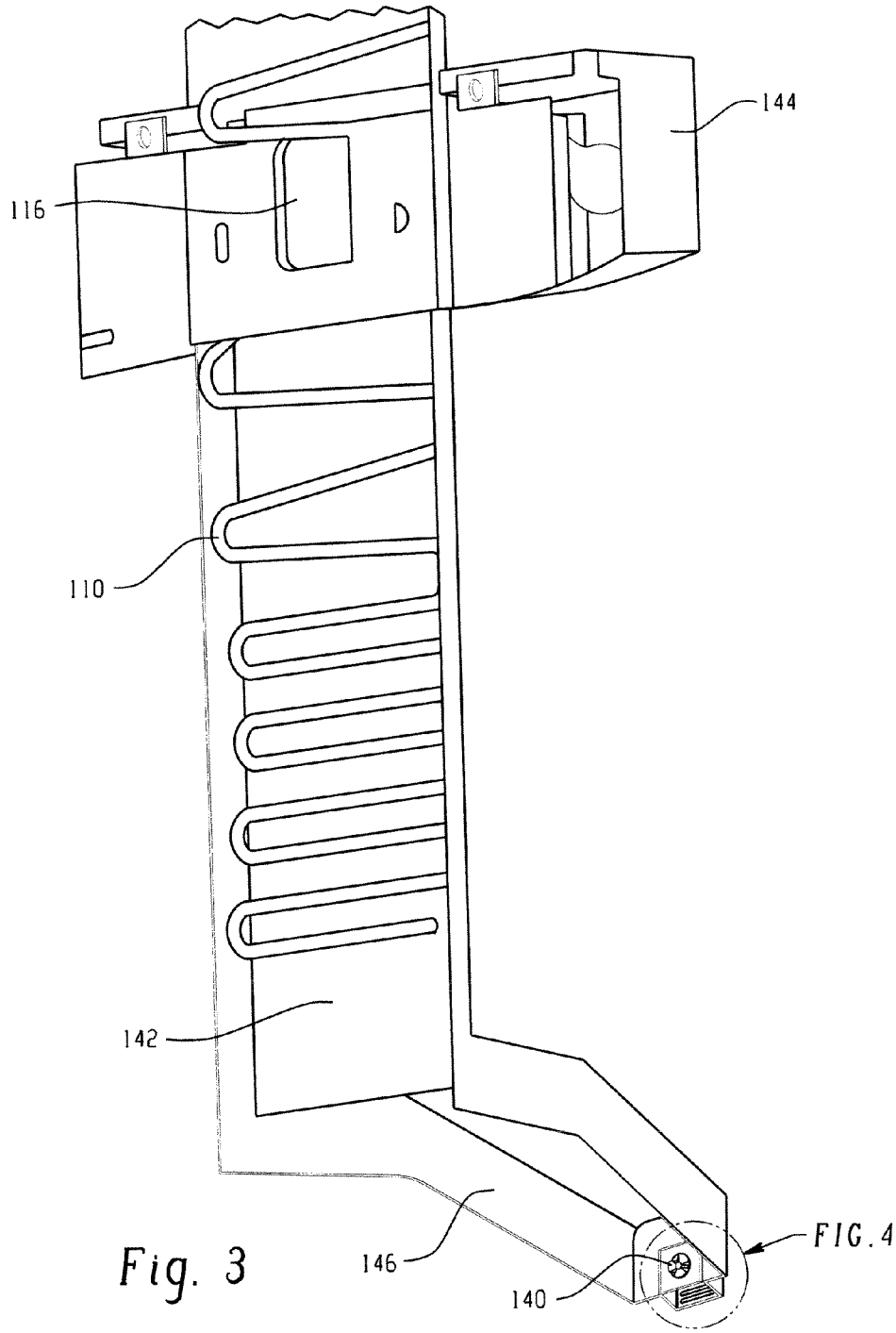
FIG. 3 is a partial rear perspective view of the fresh food evaporator and the air duct.
Figure 4:
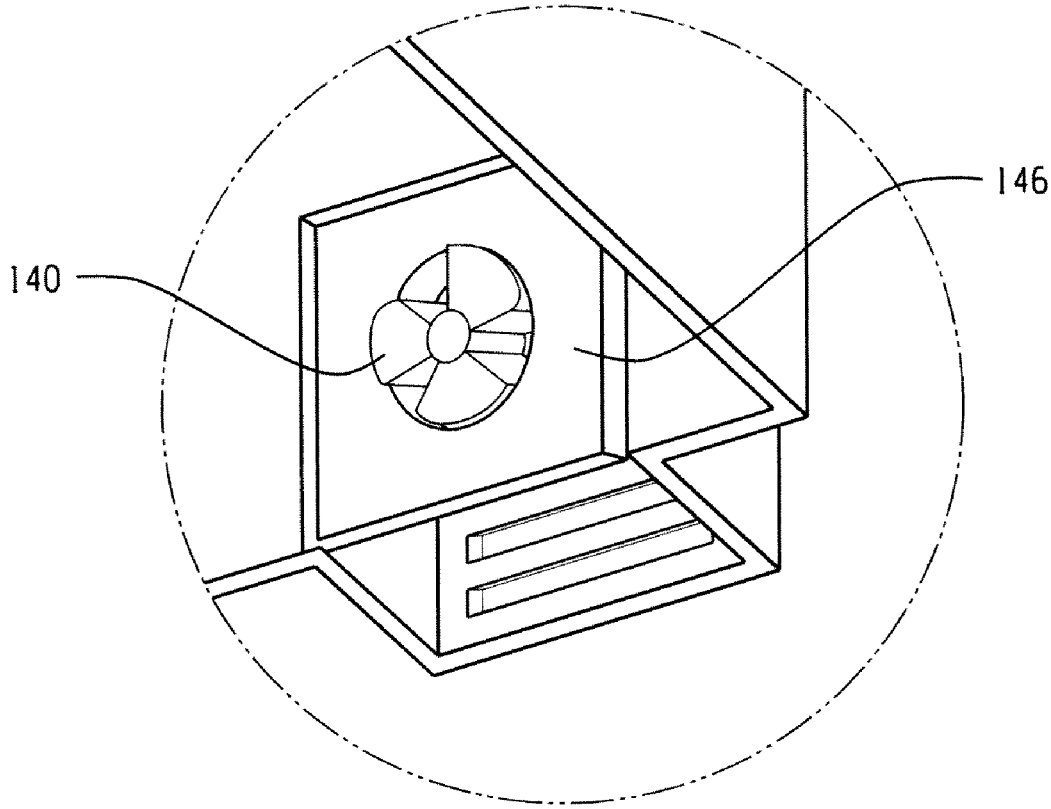
FIG. 4 is an enlarged partial perspective view of said duct of FIG. 3 showing an auxiliary fan for moving air from said fresh food evaporator toward the enclosed auxiliary compartment.

More particularly, with additional reference to FIGS. 3 and 4, the fresh food evaporator 110 can be housed within an evaporator duct 142. The evaporator fan 116, which can be referred to as the first refrigeration fan disposed in the refrigeration compartment 102, is used to pass air over the refrigeration evaporator 110 for cooling of a refrigerated compartment 102. In the illustrated embodiment, the fan 116 is disposed adjacent a light assembly 144 for providing illumination within the refrigerated compartment 102. The auxiliary fan 140, which can be referred to as the second refrigeration fan disposed in a refrigeration compartment 102, is configured to pump or move air from the refrigeration evaporator 110 to the enclosed pan 130. An air duct 146 can be disposed between the refrigerator evaporator 110 and the enclosed pan 110 for delivering the air moved by the second refrigeration fan 140 to the enclosed pan 130. The fan 140 and the duct 146 allow for independent cooling of the enclosed compartment 130 relative to the refrigerated compartment 102. Like the fans 116,118, the fan 140 can include a motor 140*a* operatively connected to the control unit 122, as shown in FIG. 1.

With particular reference to FIG. 1, a heater 148 can be disposed in the air duct 146 for heating air moved by the fan 140 to the enclosed pan 130 (e.g., when a temperature higher than that of the refrigerator compartment 102 is desired for the enclosed pan). The heater 148 can be operatively connected to the control unit 122. Also, a thermal sensor 150 can be disposed within the air duct 146 and operatively connected to the control unit 122. The control unit 122 can control the second refrigeration fan 140 based on the thermal sensor 150. Likewise, the control unit 122 can control the heater 148 based on the thermal sensor 150. According to this arrangement, the heater 148 can be controlled by the control unit 122 to selectively heat the enclosed compartment 130 to a desired temperature.

In addition, a circulating or bypass passage 154 and a damper 156 can be provided. The circulating passage 154 is in airflow communication with the enclosed pan 130 and with the air duct upstream of the auxiliary fan 140. The damper 156 is movable between a first position (the position illustrated in FIG. 1) and a second position (the position illustrated in phantom in FIG. 1). In the first position (also referred to as the open main position), airflow from the refrigeration evaporator 110 to the enclosed pan 130 is allowed and airflow through the circulating passage 154 can be blocked, as shown. In the second position (also referred to as the closed/bypass position), airflow from the refrigeration evaporator 110 to the enclosed pan is blocked by the damper 156, but airflow is circulated by or past the heater 148 through the circulating passage 154 to heat the enclosed pan 130. Blocking airflow from the evaporator 110 prevents the evaporator from cooling, or at least directing cooled air to, the enclosed pan 130 through the duct 146. As shown, the damper 156 (or a controller thereof) can be operatively connected to the control unit 122, which enables the control unit 122 to control the position of the damper 156 (e.g., move it to the first position when cooling of the enclosed pan 130 is desired and move it to the second position when heating of the enclosed pan 130 is desired).

A user interface 152 can be operatively connected to the control unit 122 for receiving input on a desired temperature of the enclosed compartment 130. The control unit 122 can control the compressor 106, the three-way valve 120, the first and second refrigerator fans 116,140, the freezer fan 118 the heater 148, and/or the damper 156 based on the input received from the user interface 152 in cooperation with measurements taken by the thermal sensor 150.

In an exemplary embodiment, the refrigerator evaporator 110 can cool the refrigerated compartment 102 to a temperature within a range of about 34° F. to about 45° F. (about 1.1° C. to about 7.2° C.). Independently, in one exemplary embodiment, the second fan 140 can be used in conjunction with the evaporator 110 and/or the heater 148 to maintain the temperature of the enclosed compartment at a desired temperature between about 30° F. to about 60° F. (about −1.1° C. to about 15.6° C.), for example. Of course, other ranges can be used (e.g., about 30° F. or −1.1° C. to about 47° F. or 8.3° C., etc.).

Such independent temperature control allows the enclosed compartment 130 to be used to maintain the temperature of a relatively small number of refrigerated items to a cooled level below that of the refrigerated compartment 102 (e.g., for fresh fish), or to a cooled level above the refrigerated compartment (e.g., for fast defrosting, such as at a temperature of about 40° F.), without otherwise affecting the temperature maintained within the refrigerated compartment 102. Accordingly, items within the enclosed compartment 130 could be cooled at a temperature other than that maintained generally in the refrigerated compartment 102 (and other than room temperature or the temperature of the freezer compartment 104). In another application, the enclosed compartment 130 can be used to rapidly or quickly chill refrigerated items received therein at a rate much faster than such items would otherwise be cooled in the refrigerated compartment 102. Unlike cooling in the freezer compartment 104, care need not necessarily be taken to remove the item at a prescribed time (e.g., before the item freezes) during rapid cooling in the enclosed compartment 130.

A control method for the dual evaporator refrigerator 100 will now be described. Through the valve 120, refrigerant is selectively provided to the fresh food evaporator 110 disposed in the fresh food compartment. Likewise, using the valve 120, the refrigerant is selectively provided to the freezer evaporator 112 disposed in the freezer compartment 104. The fresh food fan 116 adjacent the fresh food evaporator 110 is selectively operated by the controller 122 when the refrigerant is provided to the fresh food evaporator 110 for cooling of the fresh food compartment 102. Likewise, the controller 122 selectively operates the freezer fan 118 disposed adjacent the freezer evaporator 112 for cooling the freezer compartment 104 when the refrigerant is provided to the freezer evaporator 112. The controller 122 also selectively operates the auxiliary fan 140, also referred to as the second fan 140 in the refrigerated compartment relative to the fan 116, wherein the auxiliary fan 140 can direct airflow from the fresh food evaporator 110 to the enclosed compartment 130 disposed within the fresh food compartment 102.

Additionally, the controller 122 can operate the auxiliary fan 140 with the heater 148 and the damper 156 to heat airflow directed to the enclosed compartment 130 for heating thereof. Specifically, with the damper 156 in the second position, the fan 140 circulates airflow past the heater 148, through the enclosed pan 130 and back to the heater 148 via the circulating passage 154. To conserve energy, the controller 122 can turn off the compressor 106 to arrest the provision of the refrigerant to both the fresh food evaporator 110 and the freezer evaporator 112 when no cooling of the compartments 102,104 or the enclosed compartment 130 is desired. Of course, to cool the freezer compartment 104, the controller 122 operates the compressor and the valve 120 to provide the refrigerant to the freezer evaporator 112 and operates the freezer fan 118 via the freezer fan motor 118*a* to cool the freezer compartment 104. Similarly, the controller 122 operates the compressor 106 and the valve 120 to provide the refrigerant to the fresh food evaporator 110 and operates the fan 116 via the fan motor 116*a* when cooling of the fresh food compartment 102 is desired. When the refrigerant is provided to the fresh food evaporator 110, the auxiliary fan 140 can be operated by the controller to cool the enclosed compartment 130.

With reference to FIG. 5, it can be seen that a number of operating modes are provided by the refrigerator 100. For example, in operating mode 200 the compressor 106 is on, the three-way valve 120 provides refrigerant only to the freezer compartment 104 (indicated by "F"), the freezer fan 118 is on, the refrigerator fan 116 is off, the auxiliary or pan fan 140 is off, the heater 148 is off and the damper 156 is in the open main position. Thus, under the operating mode 200, cooling would only be provided to the freezer compartment 102. By way of a second example, operating mode 202 includes the compressor 106 being on, the three-way valve 120 providing refrigerant to the freezer compartment 104 and the refrigerated compartment 102 (indicated by "F/R"), the freezer fan 118 being on, the refrigerator fan 116 being on, the pan fan 140 being on, the heater 148 being on and the damper 156 in the closed/bypass position. In this mode, cooling would be provided to the refrigerator compartment 102 and the freezer compartment 104, while heat is circulated through the enclosed compartment 130. Of course, the controller 122 could coordinate the operation of the compressor 106, the valve 120, the fans 116,118 and 140, the heater 148 and the damper 156, to maintain the refrigerated compartments 102, 104 and the enclosed compartment 130 at desired temperatures. In a third example, operating mode 204 includes the compressor 106 being on, the three-way valve 120 providing refrigerant only to the refrigerated compartment 102 (indicated by "R") the freezer fan 118 being off, the refrigerator fan 116 being on, the pan fan 140 being on, the heater 148 being on and the damper 156 being in the closed/bypass position. In this mode, cooling is provided to the refrigerator compartment 102, while heat is provided to the enclosed compartment.

The exemplary embodiment or embodiments have been described with reference to preferred embodiments. Obviously, modifications and alterations will occur to others upon reading and understanding the preceding detailed description. It is intended that the exemplary embodiments be construed as including all such modifications and alterations insofar as they come within the scope of the appended claims or the equivalents thereof.

What is claimed is:

1. A dual evaporator refrigerator, comprising:

a freezer compartment;

a refrigeration compartment with an enclosed pan;

a freezer evaporator with a freezer fan for moving air from said freezer evaporator to said freezer compartment for cooling said freezer compartment;

a refrigeration evaporator with a first refrigeration fan for moving air from said refrigeration evaporator to said refrigeration compartment for cooling said refrigeration compartment;

a compressor providing refrigerant flow to said freezer and said refrigeration evaporators; and a second refrigeration fan for moving air from said refrigeration evaporator to said enclosed pan.

2. The dual evaporator refrigerator of claim 1 further including:

an air duct disposed between said refrigerator evaporator and said enclosed pan for delivering said air moved by said second refrigeration fan to said enclosed pan.

3. The dual evaporator refrigerator of claim 2 further including:

a heater disposed in said air duct for heating said air moved to said enclosed pan.

4. The dual evaporator refrigerator of claim 3 further including:

a circulating passage in airflow communication with said enclosed pan, and with said air duct upstream of said second refrigeration fan; and a damper movable between a first position wherein airflow from said refrigeration evaporator to said enclosed pan is allowed and a second position wherein airflow from said refrigeration evaporator to said enclosed pan is blocked, but airflow is circulated by said heater through said circulating passage.

5. The dual evaporator refrigerator of claim 1 further including:

a three-way valve controlling said refrigerant flow from said compressor to said freezer and said refrigeration evaporators.

6. The dual evaporator refrigerator of claim 5 further including:

a control unit operatively connected to said freezer fan, said first and second refrigeration fans, said compressor and said three-way valve for controlling operation thereof.

7. The dual evaporator refrigerator of claim 6 further including:

an air duct disposed between said refrigerator evaporator and said enclosed pan for delivering said air moved by said second refrigeration fan to said enclosed pan; and a thermal sensor disposed in said air duct, said control unit operatively connected to said thermal sensor and controlling said second refrigeration fan based on said thermal sensor.

8. The dual evaporator refrigerator of claim 7 further including:

a heater disposed in said air duct for heating said air moved to said enclosed fan, said control unit operatively connected to said heater and controlling said heater based on said thermal sensor.

9. The dual evaporator refrigerator of claim 8 further including:

a user interface operatively connected to said control unit for receiving input on a desired temperature of said enclosed pan, said controller controlling said compressor, said three-way valve, second refrigeration fan and said heater based on said input received from said user interface.

10. A dual evaporator refrigerator, comprising:

a fresh food evaporator and a fresh food fan for cooling a fresh food compartment;

a freezer evaporator and a freezer fan for cooling a freezer compartment;

a compressor and a condenser in a fluid circuit with said fresh food evaporator and said freezer evaporator for circulating a refrigerant through said fresh food and said freezer evaporators;

an auxiliary fan forcing air from said fresh food evaporator into an enclosed compartment disposed within said fresh food compartment for independently controlling cooling within said enclosed compartment.

11. The dual evaporator refrigerator of claim 10 further including:

an air duct extending between said fresh food evaporator and said enclosed compartment for directing said air forced from said auxiliary fan to said enclosed compartment.

12. The dual evaporator refrigerator of claim 10 further including:

a heater for selectively heating said enclosed compartment to a desired temperature.

13. The dual evaporator refrigerator of claim 12 further including:

a user interface for receiving input on a desired temperature of said enclosed compartment, said auxiliary fan and said heater operated in response to said input from said user interface.

14. The dual evaporator refrigerator of claim 10 further including:

a flow control device for regulating flow of refrigerant from said compressor to each of said fresh food evaporator and said freezer evaporator, said flow control device directing said refrigerant to said fresh food evaporator when cooling said fresh food compartment and directing said refrigerant to said freezer evaporator when cooling said freezer compartment.

15. The dual evaporator refrigerator of claim 14 wherein said flow control device is a three-way valve that controls flow of said refrigerant from said compressor to said freezer and said refrigeration evaporators.

16. A control method for a dual evaporator refrigerator, comprising:

selectively providing refrigerant to a fresh food evaporator disposed in a fresh food compartment;

selectively providing refrigerant to a freezer evaporator disposed in a freezer compartment;

selectively operating a fresh food fan adjacent said fresh food evaporator when said refrigerant is provided to said fresh food evaporator for cooling said fresh food compartment;

selectively operating a freezer fan adjacent said freezer evaporator when said refrigerant is provided to said freezer evaporator for cooling said freezer compartment; and selectively operating an auxiliary fan that directs airflow from said fresh food evaporator to an enclosed compartment disposed within said fresh food compartment.

17. The control method of claim 16 further including:

operating said auxiliary fan and a heater that heats said airflow directed to said enclosed compartment for heating said enclosed compartment.

18. The control method of claim 17 further including:

turning off a compressor to arrest provision of said refrigerant to both of said fresh food evaporator or said freezer evaporator.

19. The control method of claim 16 further including:

providing said refrigerant to said freezer evaporator and operating said freezer fan to cool said freezer compartment.

20. The control method of claim 16 further including:

providing said refrigerant to said fresh food evaporator and operating said fresh food fan to cool said fresh food compartment.

21. The control method of claim 16 further including:

operating said auxiliary fan to cool said enclosed compartment.

* * * * *